US007165939B2

(12) United States Patent
Chen et al.

(10) Patent No.: US 7,165,939 B2
(45) Date of Patent: Jan. 23, 2007

(54) SHAFT STRUCTURE FOR COOLING FAN ROTOR

(76) Inventors: Wei-Ming Chen, 2F, No. 192, Lien Chen Road, Chung Ho, Taipei (TW); Chih-Ming Cheng, 2F, No. 192, Lien Chen Road, Chung Ho, Taipei (TW); Chen-Lung Chou, 2F, No. 192, Lien Chen Road, Chung Ho, Taipei (TW); Kuang-Hsin Liu, 2F, No. 192, Lien Chen Road, Chung Ho, Taipei (TW)

( * ) Notice: Subject to any disclaimer, the term of this patent is extended or adjusted under 35 U.S.C. 154(b) by 97 days.

(21) Appl. No.: 10/875,162

(22) Filed: Jun. 25, 2004

(65) Prior Publication Data

US 2005/0047920 A1 Mar. 3, 2005

(30) Foreign Application Priority Data

Aug. 29, 2003 (TW) ..... 92215688 U

(51) Int. Cl.
*F04D 29/04* (2006.01)

(52) U.S. Cl. ..... 415/216.1; 416/244 R

(58) Field of Classification Search ..... 415/216.1; 416/204 R, 240, 241 B, 244 R, 206
See application file for complete search history.

(56) References Cited

U.S. PATENT DOCUMENTS 5,281,099 A * 1/1994 Hunter et al. ..... 416/244 R

* cited by examiner

*Primary Examiner*—Edward K. Look
*Assistant Examiner*—Dwayne J. White

(57) ABSTRACT

A fan shaft structure includes an annular groove portion, an end head adjacent to the groove portion, and several teeth equally spaced around the surface of the shaft. The annular groove portion, end head and teeth constitute an insert part of the fan shaft, around which the plastic fan blade is molded by insert molding. The present invention enables the center part of the fan blade to enwrap the insert part of the shaft, and firmly engage with the shaft. It is, therefore, not only able to enhance the robustness of the combination but also successful in preserving the adhesion effect between the shaft and the fan blade.

18 Claims, 6 Drawing Sheets

SHAFT STRUCTURE FOR COOLING FAN ROTOR

BACKGROUND OF THE INVENTION

The present invention relates in general to a fan shaft structure, and more particular, to a fan shaft structure suitable for a ceramic fan shaft, which is provided for combining firmly the fan shaft with the fan blade and preventing the combination from separation caused by long-term utilization.

Referring to FIG. 1, a perspective view of a conventional fan rotor in accordance with the prior art is shown. The fan shaft 1*a* has a longitudinal rod shape, with one upper end portion 10*a* and one lower end portion 11*a*. The lower end portion 11*a* is a free end portion. The other end portion 10*a* is assembled into the center part 20*a* of the fan blade 2*a*. The end portion 10*a* includes an annular groove portion 100*a*, and an end head 101*a* adjacent to the groove portion 100*a*. There are knurls 102*a* by roller forming on the root surface of the annular groove portion 100*a*. When utilizing this shaft structure to fabricate the fan rotor by insert molding, because the fan blade 2*a* is made of moldable plastic, the plastic resin is injected or squeezed into the annular groove portion 100*a*, and combines onto the knurl 102*a*. The center part 20*a* of the fan blade 2*a* enwraps the end portion 10*a* of the fan shaft 1*a*. The fan shaft 1*a* therefore combines with the fan blade 2*a*. Corresponding rotation between these two components is thus being eliminated.

However, this shaft structure, attaining engagement by means of the annular groove portion 100*a* and the knurl 102*a*, is suitable only for fan shaft made of metal material. It is pretty difficult to apply this art in manufacturing the ceramic fan shaft. Moreover, because the twill of the knurl 102*a* is shallow, the combination is not firm enough and therefore quite probable to separate. Consequently, the useful lifetime of the fan using this prior art is comparatively shorter.

BRIEF SUMMARY OF THE INVENTION

The present invention provides a shaft structure which is not only able to firmly combine one end of the fan shaft with the fan blade but also suitable for a ceramic fan shaft manufacturing. It resolves the longstanding problems like difficulty to manufacture the ceramic fan shaft, inferior engagement between the fan shaft and the fan blade, and other drawbacks. It successfully extends the useful lifetime of the cooling fan.

The shaft structure provided by the present invention includes an annular groove portion, an end head adjacent to the groove portion, and several teeth equally cut from the surface of the shaft. The present invention enables the center part of the fan blade to enwrap the insert part of the fan shaft, and firmly engage with the fan shaft. It is, therefore, not only able to enhance the robustness of the combination but also successful in preserving the adhesion effect between the fan shaft and the fan blade.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
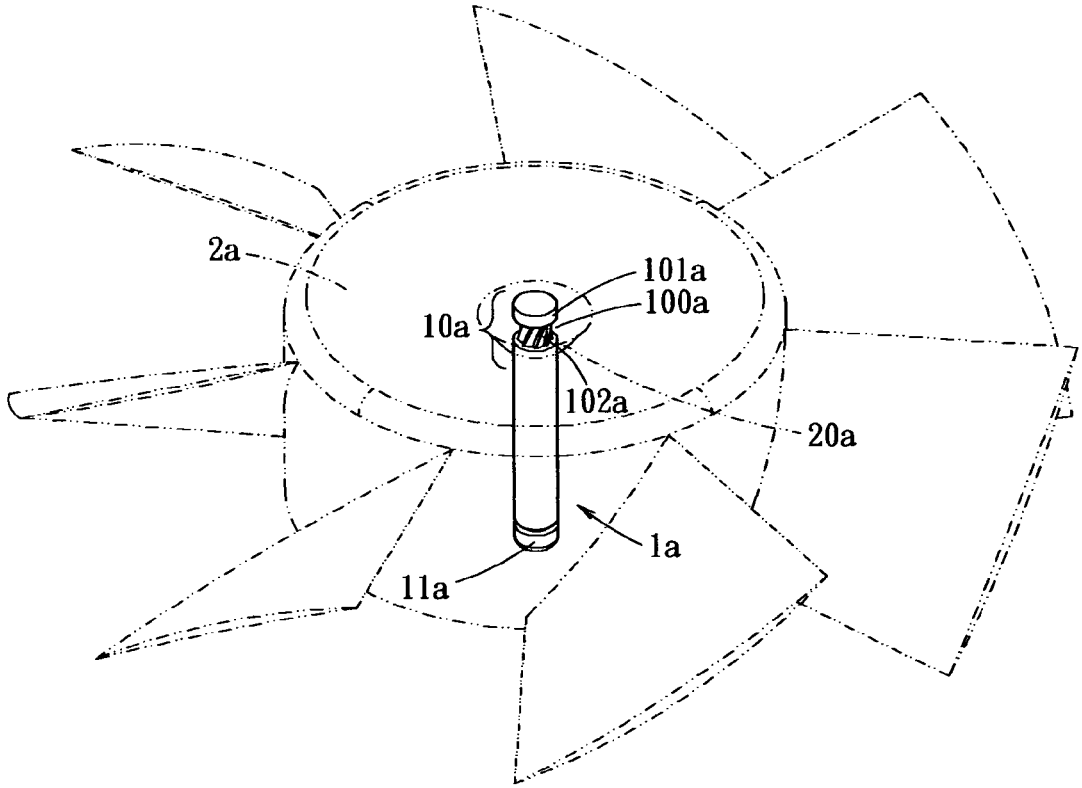
FIG. 1 PRIOR ART
FIG. 1 is a perspective view of a conventional fan rotor in accordance with the prior art.

Reference will now be made in detail to the preferred embodiments of the present invention, examples of which are illustrated in the accompanying drawings. Wherever possible, the same reference numbers are used in the drawings and the description to refer to the same or like parts.

Figure 2:
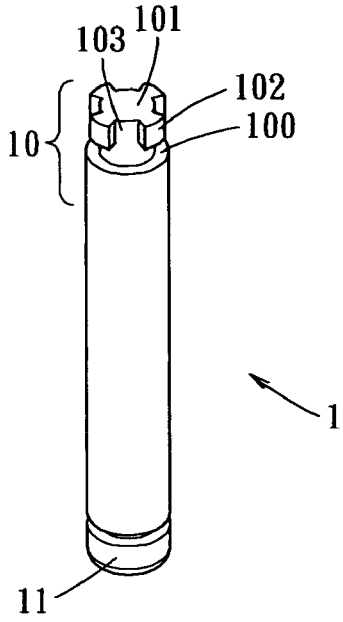
FIG. 2 is a perspective view of a fan shaft in accordance with the first embodiment of the present invention.
Figure 3:
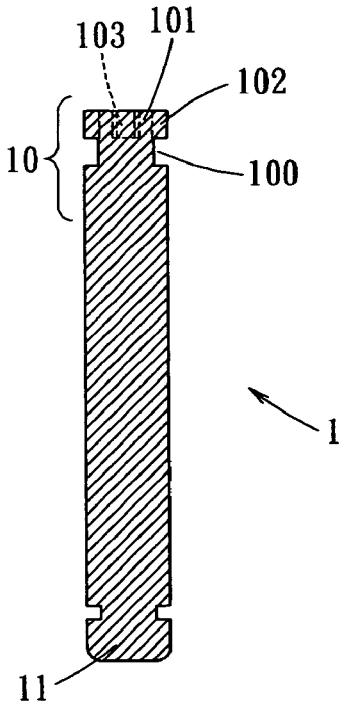
FIG. 3 is an axial cross-sectional view of a fan shaft in accordance with the first embodiment of the present invention.
Figure 4:
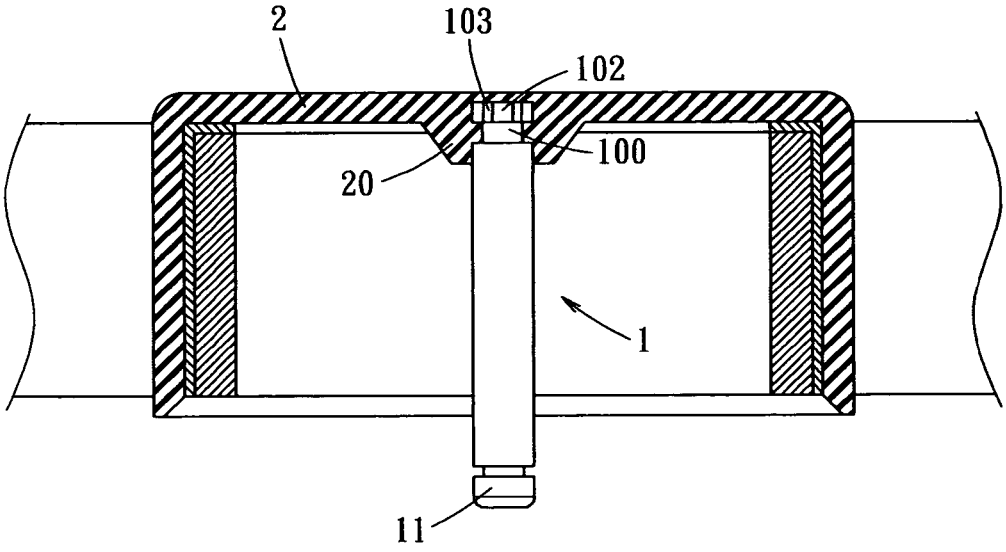
FIG. 4 is a vertical cross-sectional view of a fan shaft in accordance with the first embodiment of the present invention after insert molding.

Referring to FIG. 2 through 4, a perspective view, an axial cross-sectional view, and a vertical cross-sectional view (after insert molding) of a fan shaft in accordance with the first embodiment of the present invention are shown. The fan shaft 1 has a longitudinal rod shape, with one upper end portion 10 and one lower end portion 11. The lower end portion 11 is a free end portion. The other end portion 10 is assembled into the center part 20 of the fan blade 2, as illustrated in FIG. 4. By means of the fan shaft 1, the fan blade 2 is installed onto a fan stator, which is not shown in the figure, spins around the fan shaft 1 and produces airflow.

Because the end portion 10 of the fan shaft 1 is utilized together with the fan blade 2 for insert molding, it can be defined as an "insert part." The insert part 10 includes an annular groove portion 100 cut around close to the top of the fan shaft 1, an end head 101 adjacent to the annular groove portion 100, and several teeth 102 equally cut from the surface of the fan shaft 1. Between each two teeth 102 is a gap 103 which links to the annular groove portion 100. The cutting of the annular groove portion 100 around the surface of the fan shaft 1 produces the end head 101 on the top of the fan shaft 1. The top surface of the end head 101 is the end surface of the fan shaft 1. The gaps 103 are cut from the end head 101. The contour of the end head 101 constitutes the teeth 102.

When utilizing this shaft structure to fabricate the fan rotor by insert molding, because the fan blade 2 is made of moldable plastic, the plastic resin is injected or squeezed into the annular groove portion 100 and the gaps 103, and solidifies therein. The fan blade 2 is, therefore, so firmly engaged with the teeth 102 that the destruction of their adhesion caused by rotational torque can be prevented. At the same time, the annular groove portion 100 is helpful to bear the axial opposite force that the fan shaft 1 imposes upon the fan blade 2 while the fan producing airflow. By means of both the axial and radial engagement, the present invention resolve the separation problems caused by long-term rotational motion or incidental impact of other external forces. The present invention provides a shaft structure which enables a ceramic fan shaft to firmly engage with the fan blade 2. The center part 20 of the fan blade 2 enwraps the insert part of the fan shaft 1. Because the teeth 102 provide better engagement and spaces that the plastic resin may flow into and stick thereon, the robustness of the combination is enhanced. The lifetime of the fan thus successfully extends.

Figure 5:
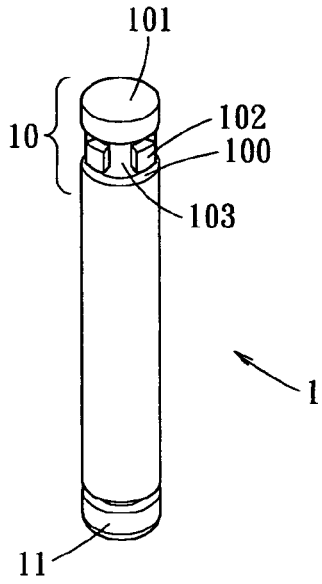
FIG. 5 is a perspective view of a fan shaft in accordance with the second embodiment of the present invention.
Figure 6:
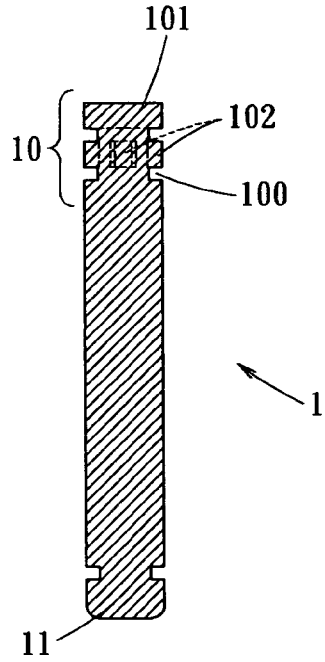
FIG. 6 is an axial cross-sectional view of a fan shaft in accordance with the second embodiment of the present invention.

Referring to FIG. 5 and FIG. 6, a perspective view, and an axial cross-sectional view of a fan shaft in accordance with the second embodiment of the present invention are shown. The teeth 102 are equally spaced on the surface of the annular groove portion 100. The shape of the end head 101 is preserved completely.

Figure 7:
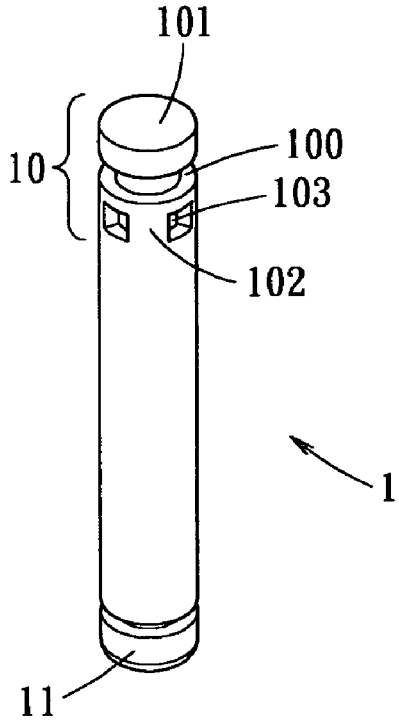
FIG. 7 is a perspective view of a fan shaft in accordance with the third embodiment of the present invention.
Figure 8:
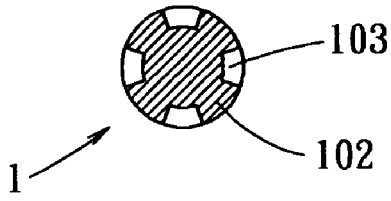
FIG. 8 is a radial cross-sectional view of a fan shaft in accordance with the third embodiment of the present invention.

Referring to FIG. 7 and FIG. 8, a perspective view and a radial cross-sectional view of a fan shaft in accordance with the third embodiment of the present invention are shown. The end head 101 and the annular groove portion 100 are the same. In addition, the teeth 102 are cut from the circumference of the fan shaft 1 below and close to the annular groove portion 100. The gaps 103 are therefore produced between each pair of the teeth. Because the outside diameter of the gear formed by the teeth 102 is the same as the diameter of the fan shaft 1, the top lands of the teeth 102 are aligned with the circumference of the fan shaft 1.

Figure 9:
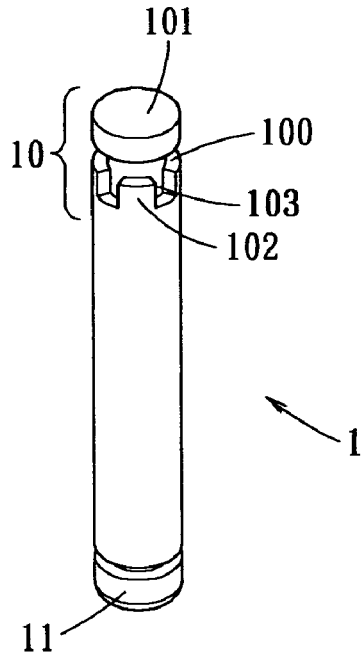
FIG. 9 is a perspective view of a fan shaft in accordance with the fourth embodiment of the present invention.
Figure 10:
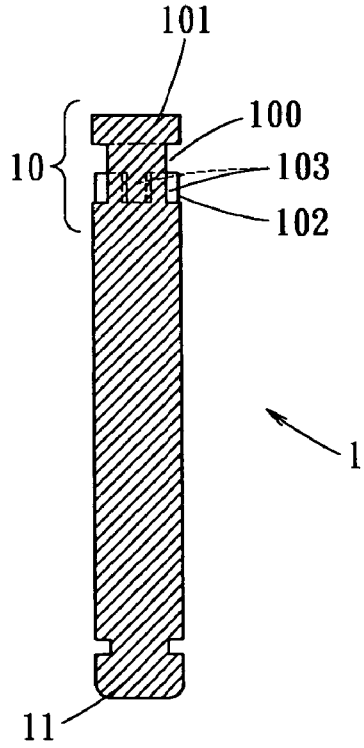
FIG. 10 is an axial cross-sectional view of a fan shaft in accordance with the fourth embodiment of the present invention.

Referring to FIG. 9 and FIG. 10, a perspective view, and an axial cross-sectional view of a fan shaft in accordance with the fourth embodiment of the present invention are shown. This embodiment is derived from the third embodiment of the present invention. Wherein, each gap 103 extends toward the annular groove portion 100 and links together with it.

Consequently, the shaft structure in accordance with the present invention at least has the following merits. First, it is suitable for the fan shaft 1 made of ceramic material. Second, it strengthens the engagement effect between the fan shaft 1 and the fan blade 2, enhances the robustness of the combination, possesses the ability to bear the axial external force, and therefore extends the useful lifetime of the cooling fan.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A fan shaft structure to firmly combine one end of a fan shaft with a fan blade, comprising:

an annular groove portion cut around the fan shaft;

an end head adjacent to the annular groove portion; and a plurality of teeth equally spaced around the surface of the fan shaft, wherein the annular groove portion, the end head and the teeth constitute an insert part of the fan shaft, around which the fan blade is molded by insert molding, and wherein the fan shaft is made of ceramic material and the fan blade is made of plastic material.

2. The fan shaft structure according to claim 1, wherein the other end portion of the fan shaft is a free end portion.

3. The fan shaft structure as recited in claim 1, wherein a contour of the end head constitutes the teeth.

4. The fan shaft structure as recited in claim 3, wherein the teeth are formed to produce a plurality of gaps between each two teeth.

5. The fan shaft structure as recited in claim 4, wherein the gaps link with the annular groove portion.

6. The fan shaft structure as recited in claim 1, wherein the teeth are equally spaced on the surface of the annular groove portion.

7. The fan shaft structure as recited in claim 1, wherein the teeth are equally cut from a circumference of the fan shaft below and close to the annular groove portion.

8. The fan shaft structure as recited in claim 1, wherein the teeth are equally cut from a circumference of the fan shaft adjacent to the annular groove portion to produce a plurality of gaps between each two teeth, and each gap extends toward the annular groove portion and links together with the annular groove.

9. A fan shaft structure to firmly combine one end of a fan shaft with a fan blade, comprising:

an annular groove portion cut around the fan shaft;

an end head adjacent to the annular groove portion; and a plurality of teeth equally spaced around the surface of the fan shaft, wherein the annular groove portion, the end head and the teeth constitute an insert part of the fan shaft, around which the fan blade is molded by insert molding, and wherein the teeth are equally spaced on the surface of the annular groove portion.

10. The fan shaft structure according to claim 9, wherein the fan shaft is made of ceramic material and the fan blade is made of plastic material.

11. The fan shaft structure as recited in claim 9, wherein a contour of the end head constitutes the teeth.

12. The fan shaft structure as recited in claim 11, wherein the teeth are formed to produce a plurality of gaps between each two teeth.

13. The fan shaft structure as recited in claim 12, wherein the gaps link with the annular groove portion.

14. A fan shaft structure to firmly combine one end of a fan shaft with a fan blade, comprising:

an annular groove portion cut around the fan shaft;

an end head adjacent to the annular groove portion; and a plurality of teeth equally spaced around the surface of the fan shaft, wherein the annular groove portion, the end head and the teeth constitute an insert part of the fan shaft, around which the fan blade is molded by insert molding, and wherein the teeth are equally cut from a circumference of the fan shaft below and close to the annular groove portion.

15. The fan shaft structure according to claim 14, wherein the fan shaft is made of ceramic material and the fan blade is made of plastic material.

16. The fan shaft structure as recited in claim 14, wherein a contour of the end head constitutes the teeth.

17. The fan shaft structure as recited in claim 16, wherein the teeth are formed to produce a plurality of gaps between each two teeth.

18. The fan shaft structure as recited in claim 17, wherein the gaps link with the annular groove portion.

* * * * *